US006003686A

United States Patent [19]

Pichler

[11] Patent Number: 6,003,686

[45] Date of Patent: Dec. 21, 1999

[54] HOLDING DEVICE FOR INK STAMPS AND OTHER OFFICE UTENSILS

[75] Inventor: Wolfgang Pichler, Wels, Austria

[73] Assignee: Trodat-Werke Walter Just, Gesellschaft m.b.H. & Co., KG, Austria

[21] Appl. No.: 09/013,168

[22] Filed: Jan. 26, 1998

[30] Foreign Application Priority Data

Jan. 24, 1997 [AT] Austria ..... 42/97 U

[51] Int. Cl.[6] ..... A47F 5/00

[52] U.S. Cl. ..... 211/39; 211/175; 248/220.31

[58] Field of Search ..... 211/39, 87.01, 211/13.1, 85.2, 175; 248/220.31, 220.41, 220.42, 220.43, 346.01, 346.03, 176.1, 127

[56] References Cited

U.S. PATENT DOCUMENTS

| | | | |
|---|---|---|---|
| 1,034,485 | 8/1912 | Moise | 211/39 |
| 1,096,391 | 5/1914 | Reininger . | |
| 1,880,947 | 10/1932 | Evans . | |
| 3,154,281 | 10/1964 | Frank . | |
| 3,263,347 | 8/1966 | McCutcheon . | |
| 3,452,959 | 7/1969 | Ishikawa . | |
| 3,483,995 | 12/1969 | Larson . | |
| 4,932,538 | 6/1990 | Gambello | 211/87.01 |
| 5,160,049 | 11/1992 | McMillen | 211/13.1 |
| 5,772,171 | 6/1998 | Masaoka et al. | 248/220.31 X |

*Primary Examiner*—Robert W. Gibson, Jr.

*Attorney, Agent, or Firm*—Venable; George H. Spencer; Robert Kinberg

[57] ABSTRACT

A device for an holding office utensil, such as an ink stamp, a self-inking stamp or other office utensil, includes a base plate including an arrangement of through holes and a spacer for supporting the base plate in a tilted position on a surface. An attachment is removably insertable in at least one of the through holes and is adapted for holding the office utensil.

11 Claims, 6 Drawing Sheets

HOLDING DEVICE FOR INK STAMPS AND OTHER OFFICE UTENSILS

CROSS-REFERENCE TO RELATED APPLICATIONS

This application claims the right of priority with respect to application GM 42/97 filed in Austria on Jan. 24, 1997, the disclosure of which is incorporated herein by reference.

BACKGROUND OF THE INVENTION

The invention concerns a holding device for ink stamps and other office utensils.

Ink stamps and like items are as a rule held in rotating stamp holding devices. However, these are only suitable for stamps with a head. In recent times, self-inking stamps have increasingly come into use which have an essentially parallelepiped housing that does not offer the holding device a place of engagement.

SUMMARY OF THE INVENTION

It is an object of the invention to provide a holding device of the aforementioned type which is suitable for traditional stamps as well as for self-inking stamps and for holding other office utensils that generally clutter a desk.

The above and other objects are accomplished according to the invention by the provision of a device for holding an office utensil, such as a self-inking stamp, a non-self-inking stamp or other office utensil, comprising: a base plate including an arrangement of through holes; a spacer for supporting the base plate in a tilted position on a surface; and an attachment removably insertable in at least one of the through holes and adapted for holding the office utensil.

The device according to the invention is preferably distinguished by a polygonal, preferably rectangular, base plate, which can be supported on a surface with the aid of at least one spacer and has an arrangement of through holes for a removable insertion of one or more attachments, onto which self-inking stamps can be fitted, other stamps can be hung, or which serve as holding devices for other office utensils.

This design makes it possible to provide different attachments for different self-inking stamps, onto which the self-inking stamps can be fitted. Insertable attachments can be provided at the same time for holding the traditional-type stamps with a head and other office or writing utensils. This ensures an orderly and easy-to-survey place of deposit for stamps and office utensils on a desk.

According to the invention, the holes are extended on the underside of the base plate by preferably cylindrical projections.

In accordance with another characteristic of the invention, the spacer projects outward from one edge of the base plate in the form of a strip, preferably at a right angle from the base plate.

In accordance with a preferred embodiment of the invention, the base plate has on its underside a seat for a coupling element for mutually linking two adjoining base plates. The seat is located in the region of at least one of the free edges of the base plate. This specific embodiment makes it possible, for example, to fit several rectangular base plates together in a modular design to form a larger base plate.

The coupling element is advantageously designed as an assembly angle, which can be inserted with one leg between parallel holding ribs on the underside of the base plate and can be fitted onto the projections of two holes, and which has on its other leg receptacles for edge ribs on the side edges of neighboring spacers.

In accordance with another characteristic of the invention, the attachments have pegs that can be fitted into the holes and which are preferably slotted on their free end, so that they snap into the holes. It is practical if all parts of the holding device according to the invention are made of plastic.

BRIEF DESCRIPTION OF THE DRAWINGS

The invention is explained in the following in more detail with the aid of an embodiment and by referring to the drawings, which show.

DETAILED DESCRIPTION OF THE INVENTION

Figure 1:
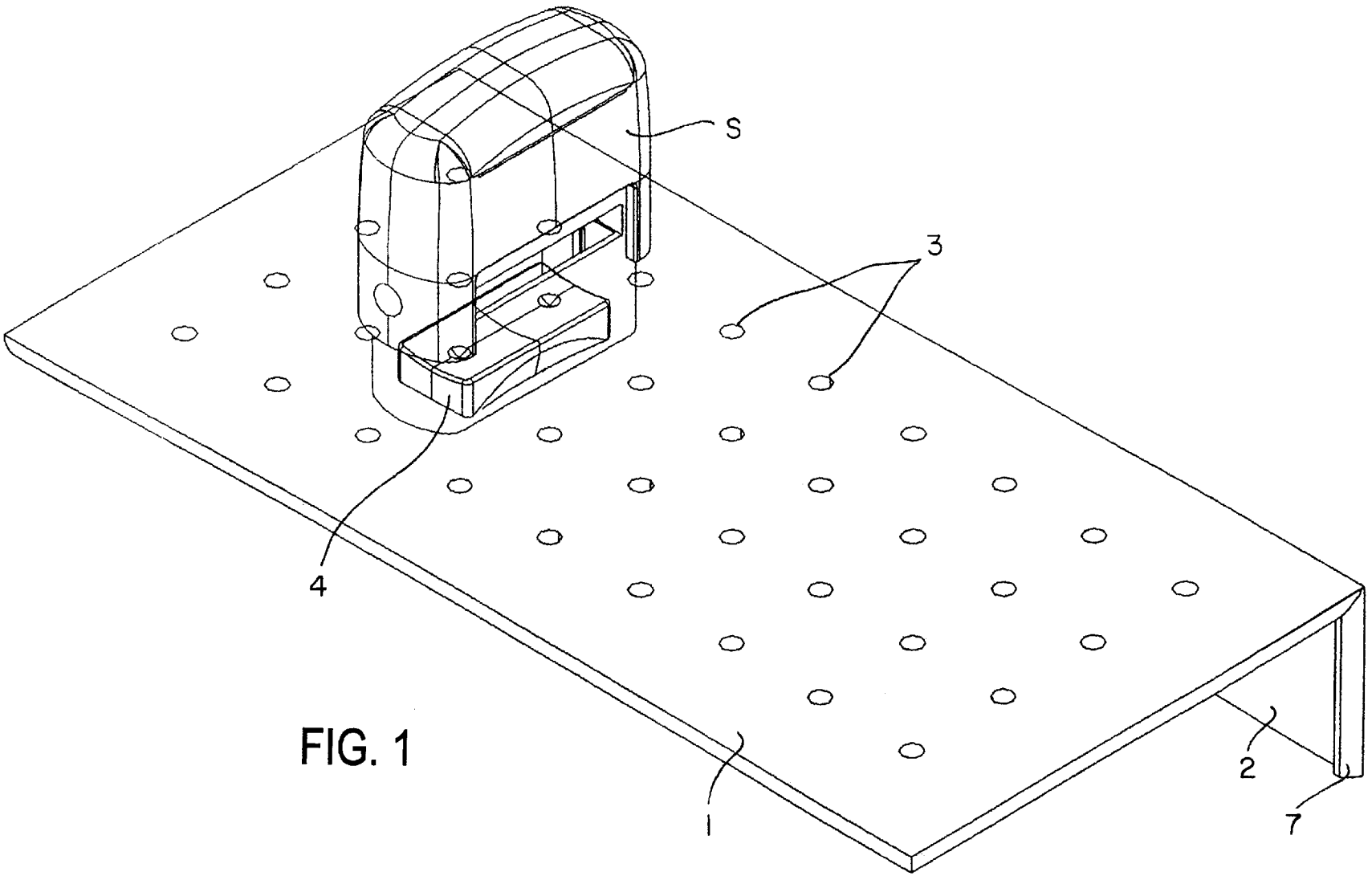
FIG. 1 is a perspective view of a base plate according to the invention.
Figure 2:
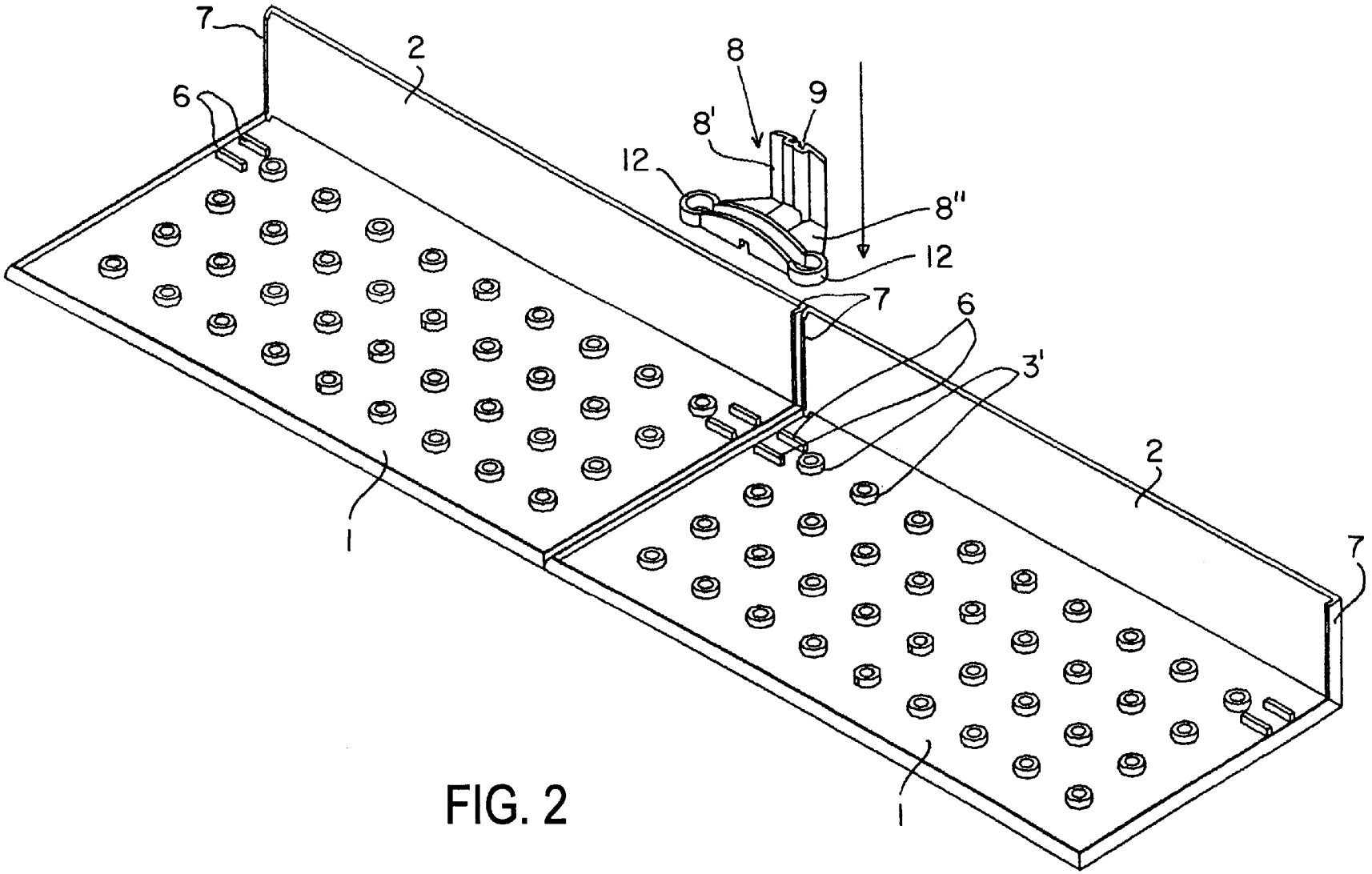
FIG. 2 is a view from below of two base plates in a modular connection according to FIG. 1.
Figure 3:
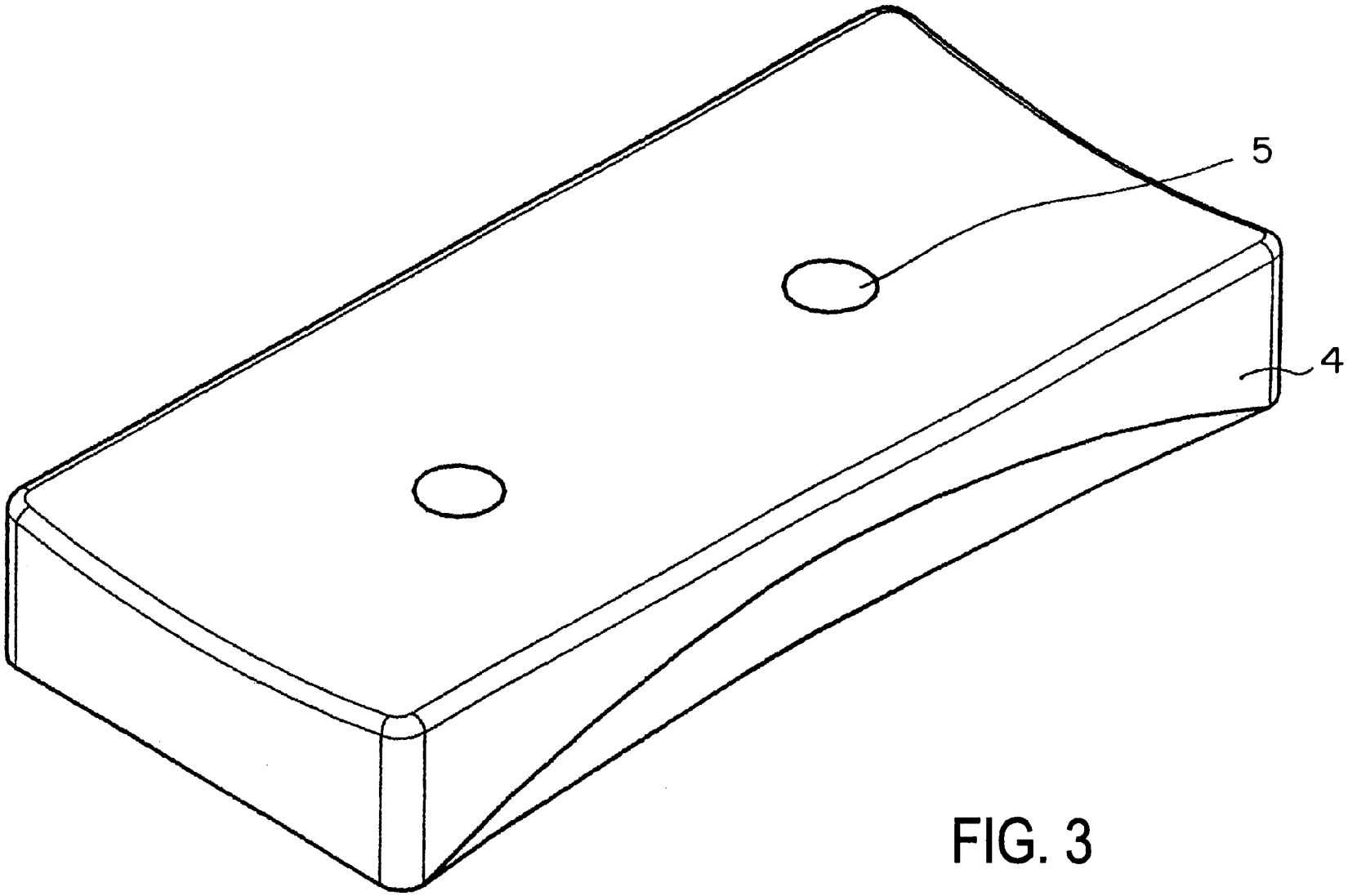
FIG. 3 is an enlarged perspective view of an attachment that can be inserted into the base plate.
Figure 4:
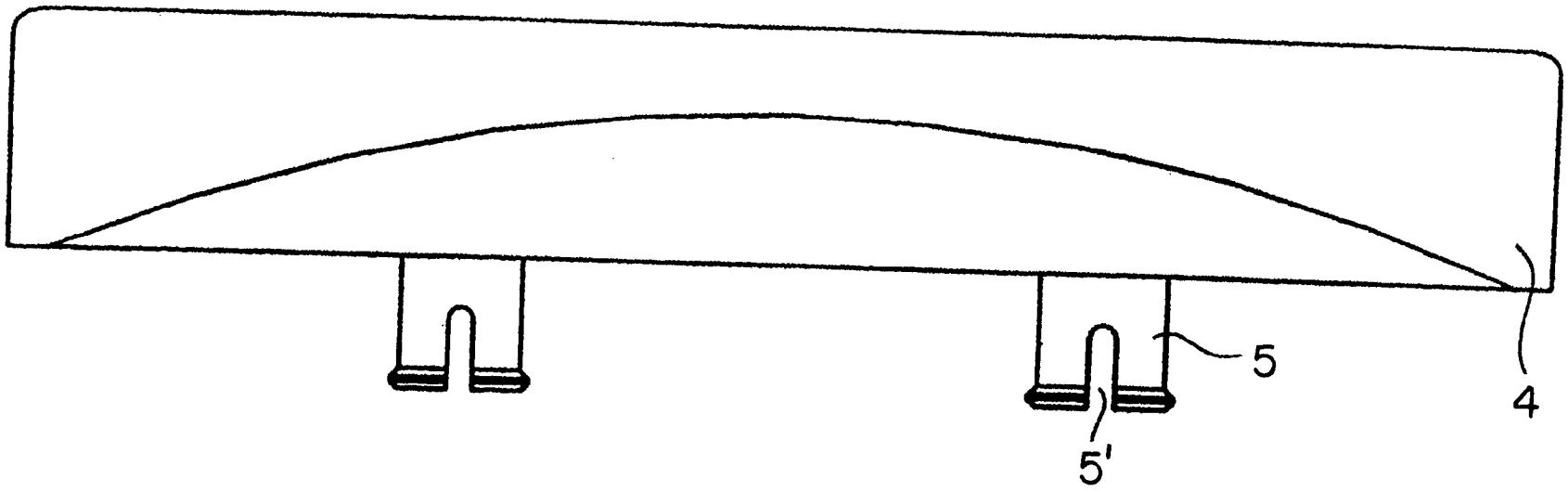
FIG. 4 is a view from the side of the attachment according to FIG. 3.

Referring to FIG. 1 there is shown a holding device according to the invention which includes at least one base plate 1. For the embodiment shown, the base plate comprises a rectangular plate which is provided with a strip-type spacer 2 on a rear longitudinal edge that projects at a preferably right angle away from the base plate 1, so that the base plate can be placed in a tilted position on a base, for example, a desk. Base plate 1 is provided with an arrangement of holes 3, for example a grid of holes, which are extended on the underside of the base plate by suitable cylindrical projections 3' as shown in FIG. 2. An attachment 4 can be inserted into holes 3 as shown in FIG. 1. Attachment 4, shown in detail in FIGS. 3 and 4, is adapted to the lower opening of an indicated self-inking stamp S and has two pegs 5, which can be inserted into two neighboring holes 3. According to FIG. 4, the pegs 5 are provided with slots 5' at their lower end, so that they enter into a snap-in connection with holes 3 or projections 3'.

FIG. 2 shows a joining of two or more base plates 1. Each base plate 1 according to FIG. 2 has two parallel ribs 6 on its underside in an edge region of one of its small sides. Additionally, spacers 2 are provided at each of their small side edges with a rib 7.

Figure 5:
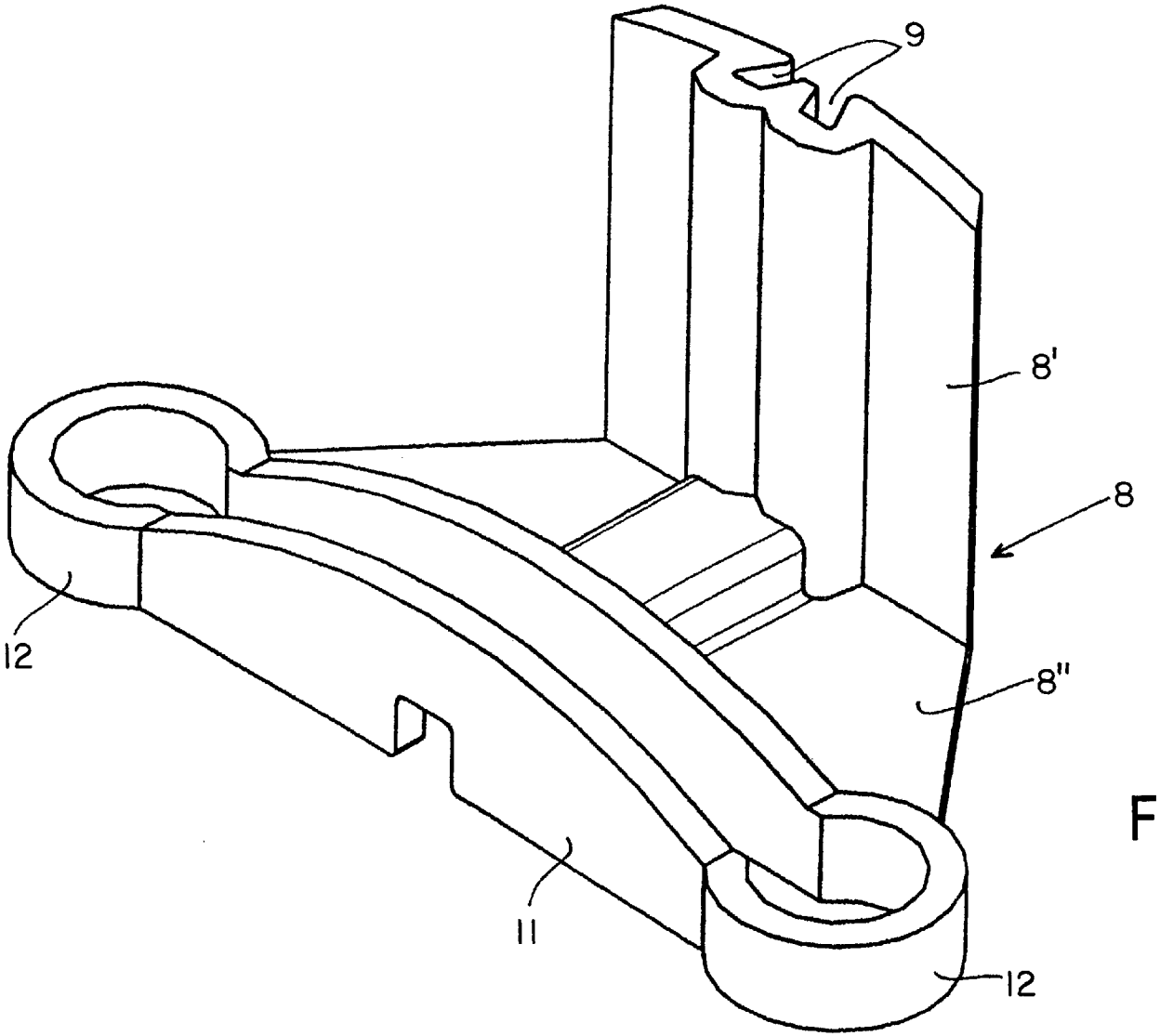
FIG. 5 is a perspective view of a coupling element for linking two base plates.
Figure 6:
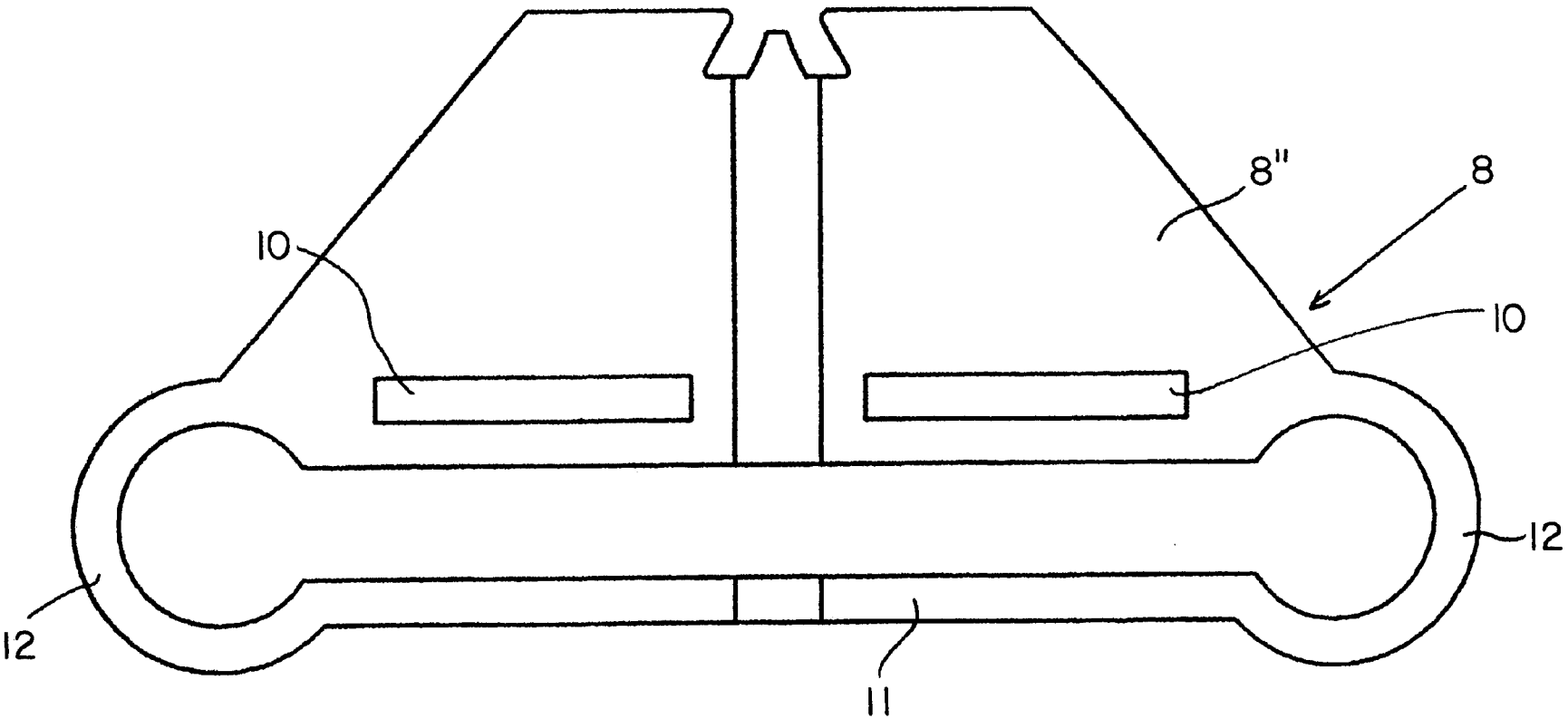
FIG. 6 is a view from below of the coupling element according to FIG. 5.

A coupling element 8, which is enlarged and shown in greater detail in FIGS. 5 and 6, can be made to engage form-fittingly and frictionally with ribs 6, 7.

Coupling element 8 has an essentially right angle design and includes one leg 8' with two groove-shaped receptacles 9 for neighboring ribs 7 of adjoining spacers 2, and another leg 8" provided with two slots 10 for receiving two ribs 6 of the adjoining base plates 1. An elastically deformable, bridgeshaped section 11 of leg 8" enters into a clamping connection with the two other ribs 6 of adjoining base plates 1. Two circular extensions 12 also enter into a clamping connection with the cylindrical projections 3' of two adjacent holes 3 in base plate 1.

Various modifications of the explained embodiment are possible within the framework of the general inventive concept. Thus, the base plate can also have a shape other than the rectangular one, e.g. square, hexagonal, etc. However, it could also have a round or oval shape. In place of the special coupling elements, the mutual linking of two adjoining base plates could also be achieved with the aid of attachments inserted into neighboring holes in the base plates. The hole grid can differ from the one shown in the drawing, but it makes sense to design it such that the attachments can be inserted aligned in at least two different directions. The shape of the attachments can differ from the one shown, wherein it is also possible to provide attachments that hold pads of paper, for example, or can serve as trays for holding writing instruments. Plastic is a suitable material to be considered for the individual parts. However, the parts can also be fashioned from metal or wood. If the base plate is made from metal, it is possible to provide attachments held by magnetic force on the base plate. Additionally, the base plate can be inserted via its spacer, for example, in a wall holding device that is not shown here.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A device for holding a stamp, comprising:

a base plate including an arrangement of through holes, the base plate having an underside;

a spacer for supporting the base plate in a tilted position on a surface;

an attachment removably insertable in at least one of the through holes and adapted for holding the stamp, the attachment having pegs that can be fitted into the through holes, the pegs including free ends that are slotted so that they snap into the through holes; and projections on the underside of the base plate for extending the through holes, respectively, wherein the underside of the base plate includes a coupling region adjacent an edge of the base plate, the coupling region having parallel holding ribs, wherein two of said base plates and said spacers are disposed adjoining one another, wherein said spacers have adjoining side edges, with each side edge including an edge rib, and wherein said device further comprises a coupling element which includes an assembly angle member having a first leg which is inserted between the parallel holding ribs on the undersides of the adjoining base plates and which can be fitted onto the projections of two holes, and having a second leg with receptacles for the edge ribs of the adjoining spacers.

2. A device for holding an office utensil, comprising:

a first base plate having an arrangement of through holes, the first base plate additionally having an underside and a coupling region on its underside adjacent an edge of the first base plate;

a second base plate having an arrangement of through holes, the second base plate additionally having an underside and a coupling region on its underside adjacent an edge of the second base plate, the second base plate being disposed beside the first base plate, with the coupling region of the second base plate being adjacent the coupling region of the first base plate;

a first spacer for supporting the first base plate in a tilted position on a surface, the first spacer having an edge rib;

a second spacer for supporting the second base plate in a tilted position on the surface, the second spacer having an edge rib that is disposed adjacent the edge rib of the first spacer;

a coupling element having a first portion with means for engaging the coupling region of the first base plate and the coupling region of the second base plate so as to join the base plates via their coupling regions, the coupling element additionally having a second portion with receptacles for receiving the edge ribs of the first and second spacers; and an attachment member for holding the office utensil, the attachment member having a peg which is inserted through one of the through holes.

3. The device according to claim 1, wherein the stamp is a self-inking stamp having an open-ended housing skirt, and wherein the attachment is adapted so that the open-ended housing skirt of the self-inking stamp can be fitted thereon.

4. The device according to claim 1, wherein the stamp is an ink stamp and the attachment is adapted so that the ink stamp can be hung therefrom.

5. The device of claim 2, wherein the attachment member further includes another peg which is inserted through another of the through holes.

6. The device of claim 2, wherein the through holes of the first base plate include a through hole in the coupling region of the first base plate and the through holes of the second base plate include a through hole in the coupling region of the second base plate, wherein the coupling region of the first base plate has a projection for extending the through hole in the connection region of the first base plate and the coupling region of the second base plate has a projection coupling region for extending the through hole in the connection region off the second base plate, and wherein the means for engaging the coupling region of the first base plate and the coupling region of the second base plate comprises at least one recess in the first portion of the coupling elements to receive the projections.

7. The device of claim 6, wherein the coupling region of the first base plate has a rib and the coupling region of the second base plate has a rib, and wherein the means for engaging the coupling region of the first base plate and the coupling region of the second base plate further comprises at least one slot in the first portion of the coupling element for receiving the ribs.

8. The device of claim 7, wherein the coupling region of th first base plate also has another rib which engages an outer side for the first portion of the coupling element, and the coupling region of the second base plate also has another rib which engages the outer side of the first portion of the coupling element.

9. The device of claim 8, wherein the ribs of the coupling region of the first base plate are substantially straight and are disposed substantially parallel to one another, and the ribs of the coupling region of the second base plate are also substantially straight and are disposed substantially parallel to one another.

10. The device of claim 7, wherein the coupling region of the first base plate has a rib and the coupling region of the second base plate has a rib, and wherein the means for engaging the coupling region of the first base plate and the coupling region of the second base plate comprises at least one slot in the first portion of the coupling elements for receiving the ribs.

11. The device of claim 2, wherein the office utensil is a self-inking stamp having an open-ended housing skirt, and wherein the attachment is configured so that the open-ended housing skirt can be fitted onto the attachment in order to releasably hold the self-inking stamp.

* * * * *